US007487708B2

(12) United States Patent
Harashima et al.

(10) Patent No.: US 7,487,708 B2
(45) Date of Patent: Feb. 10, 2009

(54) FLUID PRESSURE CYLINDER

(75) Inventors: Yasuo Harashima, Tokyo (JP); Yoshiaki Nakajima, Tokyo (JP); Hiroshi Gunji, Tokyo (JP)

(73) Assignee: Koganei Corporation, Tokyo (JP)

( * ) Notice: Subject to any disclaimer, the term of this patent is extended or adjusted under 35 U.S.C. 154(b) by 243 days.

(21) Appl. No.: 11/138,721

(22) Filed: May 26, 2005

(65) Prior Publication Data

US 2005/0214132 A1 Sep. 29, 2005

Related U.S. Application Data

(63) Continuation of application No. PCT/JP03/10978, filed on Aug. 28, 2003.

(30) Foreign Application Priority Data

Nov. 29, 2002 (JP) ..... 2002-347228

(51) Int. Cl.
*F15B 15/24* (2006.01)

(52) U.S. Cl. ..... 92/13.6

(58) Field of Classification Search ..... 92/13.6
See application file for complete search history.

(56) References Cited

U.S. PATENT DOCUMENTS 2,605,748 A 8/1952 Rasoletti
2,648,096 A 8/1953 Baigent
2,655,058 A * 10/1953 Eschenburg et al. ..... 92/13.6
3,771,930 A 11/1973 Ginzel et al. ..... 425/78
4,545,289 A * 10/1985 Weyer ..... 92/13.6
4,970,943 A * 11/1990 Salg et al. ..... 92/13.6

FOREIGN PATENT DOCUMENTS

| | | |
|---|---|---|
| DE | 41 27 088 A1 | 2/1993 |
| FR | 2 231 873 A1 | 12/1974 |
| JP | 02048136 A | 2/1990 |
| JP | 7-1304 | 1/1995 |

* cited by examiner

*Primary Examiner*—F. Daniel Lopez
(74) *Attorney, Agent, or Firm*—McCormick, Paulding & Huber LLP

(57) ABSTRACT

The female screw (8*a*) is formed on the inner circumference of the forward side of the piston receiving hole (8) in the cylinder body (2) and the movable stopper (9) is screwed into the female screw (8*a*). The piston (12) is located at the stroke end of the forward side when its end face of the forward side is contact with the end face of the backward side of the movable stopper (9). The rotating knob (4) is rotatably mounted on the end of the forward side of the cylinder body (2). The rotation transmitting pin (16) is projected on the end face of the backward side of the rotating knob. The rotation transmitting hole (9*a*) is formed on the end face of the forward side of the movable stopper (9). The rotation transmitting pin (16) is slidably inserted into the rotation transmitting hole. When the rotating knob (4) is rotated, the movable stopper (9) is screwed into so that the stroke end position and the moving stroke of the piston (12) can be adjusted.

5 Claims, 4 Drawing Sheets

FLUID PRESSURE CYLINDER

CROSS-FEFERENCE TO RELATED APPLICATIONS

This application is a continuation of International Application No. PCT/JP2003/010978, filed Aug. 28, 2003, and claims the benefit of Japanese Patent Application No. JP 2002-347228, filed Nov. 29, 2002.

TECHNICAL FIELD

The present invention relates to a fluid pressure cylinder including a rod to reciprocate by fluid pressure.

BACKGROUND ART

The conventional fluid pressure cylinder serves as a reciprocating actuator activated by air pressure or hydraulic pressure. The fluid pressure cylinder comprises a cylinder body having a cylinder chamber therein, a piston reciprocally provided in the cylinder chamber and separating the cylinder chamber into a forward fluid pressure chamber and a backward fluid pressure chamber, and a piston rod fixed to the end face of the piston and projecting externally from the cylinder body.

One of the fluid pressure chambers is supplied with the fluid pressure and the other of the fluid pressure chamber is vented so that the piston and the piston rod are pressed to move to the opposite side. The position at which the piston is stopped moving by contacting a cover or stopper provided on the end of the cylinder body is a stroke end position of the forward side or a stroke end position of the backward side.

Usually, when such fluid pressure cylinder is used for equipment, the cylinder body is fixed to the equipment body. However, it may be necessary to optionally adjust the stroke end position of the forward side and the stroke end position of the backward side of the piston rod or the stroke length of the piston rod therebetween relative to the fixed positions of the cylinder body.

In one conventional single rod fluid pressure cylinder, an adjusting rod projected from the cylinder body to the opposite side of the piston rod is fixed to the piston, and the axial position of an adjusting nut screwed into the circumference of the projecting portion is changed so that the position at which the adjusting nut is contacted the rear end of the cylinder body, i.e. the stroke end position of the forward side of the piston rod is adjusted. Additionally, in another conventional single rod fluid pressure cylinder, an adjusting bolt is screwed into the end of the backward side of the cylinder body and further screwed to insert into the cylinder body to change the depth of the adjusting bolt in the cylinder body so that the position at which the piston is contacted the leading edge of the adjusting bolt, i.e., the stoke end position of the backward side of the piston rod is adjusted.

In the above mentioned both of the adjustments for the stroke, it was required to take an axially long installation space because long adjustment members such as the adjusting rod and the adjusting bolt are provided on the end of the backward side of the cylinder body. Additionally, it was not be able to be applied to a double rod cylinder having a piston rod to activate in the backward side of the piston.

The object of the present invention is to provide a fluid pressure cylinder in which at least one of the stroke end position of the forward side or the stroke end position of the backward side of the piston rod can be adjusted without having the axially long adjustment member.

The object of the present invention is to provide a fluid pressure cylinder in which at least one of the stroke end position of the forward side or the stroke end position of the backward side of the piston rod can be adjusted even if the cylinder is a double rod type.

DISCLOSURE OF THE INVENTION

In the fluid pressure cylinder according to the present invention, when a rotating knob is rotated, a movable stopper is screwed into thereby the axial position can be changed and also the stroke end position and the moving stroke of the piston can be adjusted. The total length for the fixed portion combined the rotating knob with the cylinder body is not changed during adjusting. Additionally, since the axially long adjustment members are not provided on the end of the backward side of the cylinder body, the fluid pressure cylinder can be installed in a small space. Further, the fluid pressure cylinder according to the present invention can be applied to the configuration such that the stroke end position of both of the forward side and the backward side are adjusted, and a double rod type.

BRIEF DESCRIPTION OF THE DRAWINGS

FIG. 2A is a sectional view when the movable stopper is located at the forward limit. FIG. 2B is a sectional view when the movable stopper is located at the backward limit;

BEST MODE FOR CARRYING OUT THE INVENTION

Hereinafter the preferred embodiments of the present invention are described in detail with reference to the drawings.

Figure 1:
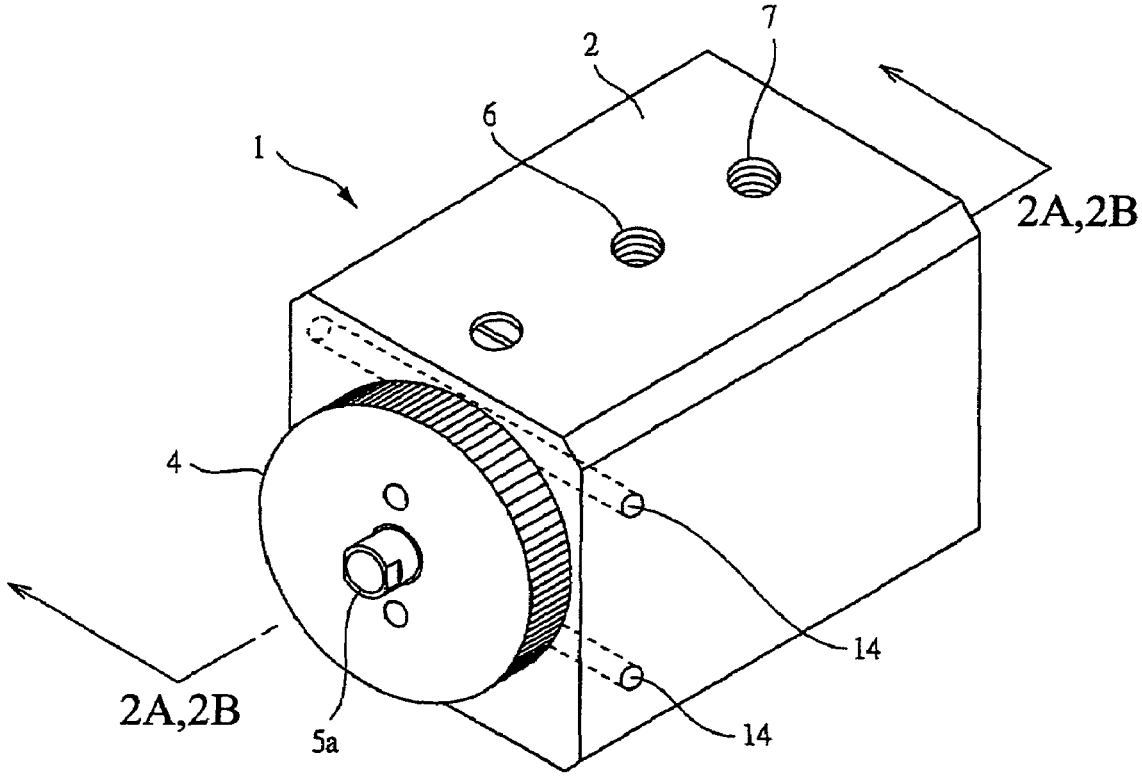
FIG. 1 is a general perspective view of the fluid pressure cylinder 1 according to one embodiment.

FIG. 1 is a general perspective view of the fluid pressure cylinder according to one embodiment. A rotating knob 4 formed of approximate circular disk is rotatably provided on the front surface of a cylinder body 2 formed of approximate rectangular parallelepiped as shown FIG. 1. A piston rod 5*a* externally projecting through the rotating knob 4 is slidably mounted in the cylinder body 2. Two supply and discharge ports 6 and 7 formed on the upper surface of the cylinder body 2 as shown FIG. 1 are controllably supplied with compressed air, respectively so that the fluid pressure cylinder 1 serves as a double acting air cylinder to reciprocate the piston rod 5*a*. The direction to which the piston rod projects from the cylinder body 2 (left hand in each figure) is the forward direction of the piston rod 5*a*, alternatively, the direction into which the piston rod draws (right hand in each figure) is the backward direction of the piston rod 5*a*.

Figure 2A:
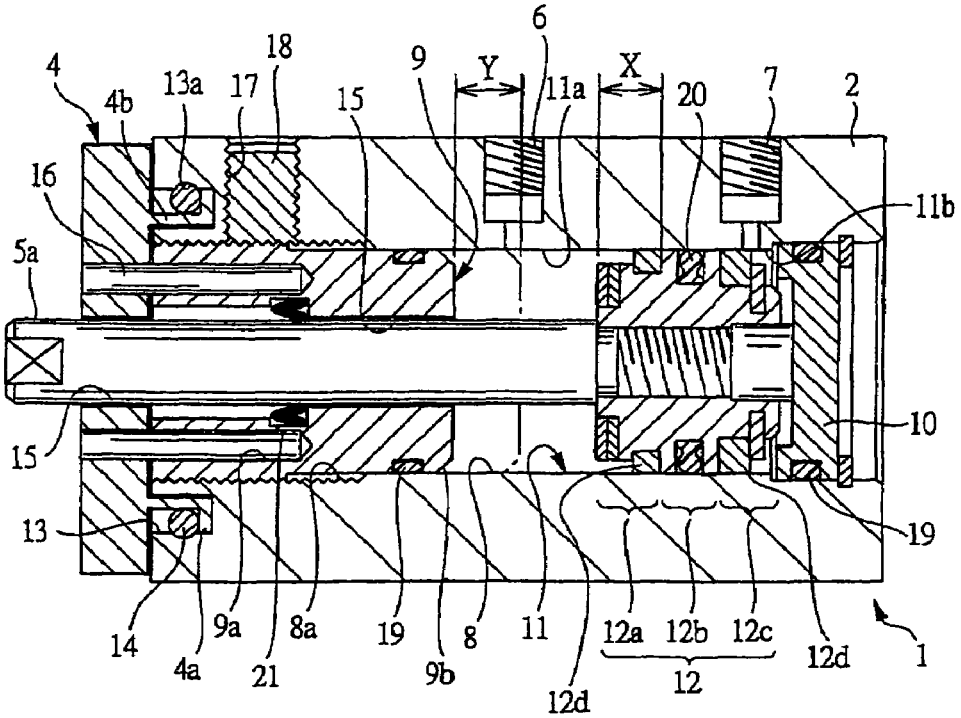
FIGS. 2A and 2B are sectional views along the A-A line of FIG. 1 when the piston rod is located at the stroke end of the backward side.
Figure 2B:
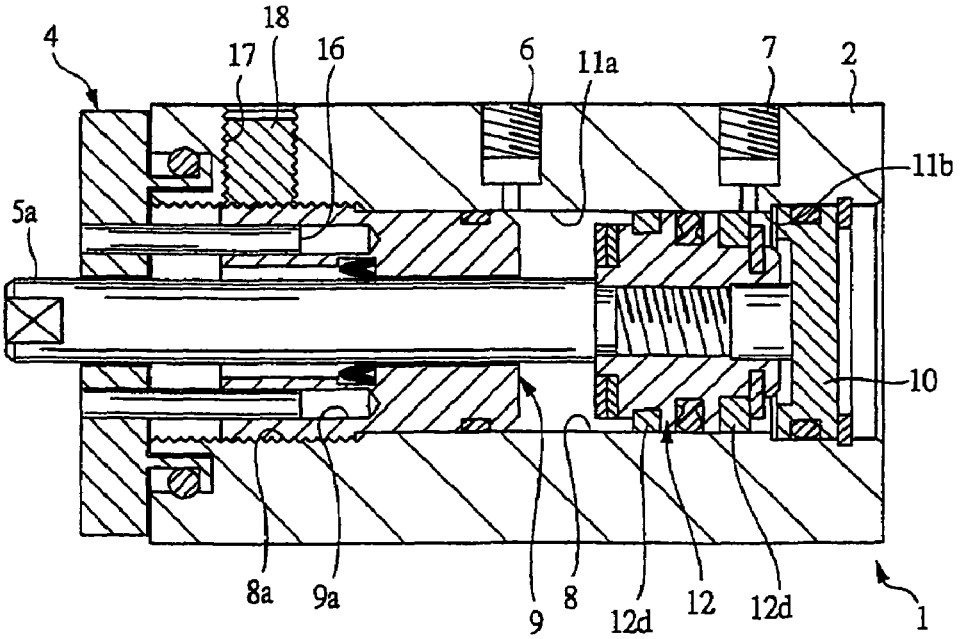

FIGS. 2A and 2B are sectional views along the A-A line of FIG. 1 when the piston rod 5*a* is located at the inmost stroke end position in the backward side. FIG. 2A is a sectional view when the movable stopper is located at the forward limit. FIG. 2B is a sectional view when the movable stopper is located at the backward limit. A piston receiving hole 8 is formed in a longitudinal direction in the cylinder body 2 as shown FIG. 2A and FIG. 2B. In the piston receiving hole 8, a cylinder chamber 11 is formed in the space in which a movable stopper 9 at the forward side and a cylinder-head cover 10 at the backward side are provided. A piston 12 is axially and reciprocally mounted in the cylinder chamber 11. The inside of the cylinder chamber 11 is separated into a backward fluid pressure chamber 11*a* and a forward fluid pressure chamber 11*b* by the piston 12. A rotating knob 4 formed of approximate circular disk is provided on the end of the forward side of the cylinder body 2. The piston rod 5*a* fixed to the end face of the forward side of the piston 12 is slidably supported through the center of the rotating knob 4 and the movable stopper 9.

The piston 12 is formed of approximate cylinder. The outer diameter of a forward end 12*a* and a backward end 12*b* of the piston 12 is slightly smaller than a slidable middle portion 12*b* therebetween. The slidable middle portion 12*b* is fitted into and slidably contact with the piston receiving hole 8. The forward end 12*a* and the backward end 12*c* are not contact with the inner surface of the piston receiving hole 8. Wear rings 12*d* are mounted on each circumference of the forward end 12*a* and the backward end 12*c*. The wear rings 12*d* sandwich the slidable middle portion 12*b* therebetween. The wear rings 12*d* can maintain to be in fluid communication with the backward fluid pressure chamber 11*a* and the forward fluid pressure chamber 11*b* without blocking up the supply and discharge ports 6 and 7 even if those axial position is same as each of the supply and discharge ports 6 and 7 while the wear rings 12*d* are in slidably contact with the piston receiving hole 8.

A female screw 8*a* is provided on the inner circumference of the forward side of the piston receiving hole 8 thereby the movable stopper 9 is screwed into the piston receiving hole 8. The movable stopper 9 rotates around the axis to screw into thereby to axially reciprocate. A cylinder-head cover 10 is fitted into the backward side of the piston receiving hole 8. The piston 12 is located at the stroke end of the forward side while its end face of the forward side is contact with the end face of the backward side of the movable stopper 9. Alternatively, the piston 12 is located at the stroke end of the backward side while its end face of the backward side is contact with the end face of the forward side of the cylinder-head cover 10.

Additionally, a retaining groove 13 is formed on the concentric circle slightly outer than the opening of the piston receiving hole 8 on the end face of the forward side of the cylinder body 2, and an engaging groove 13*a* is formed on the side wall of the outer circumference.

A cylindrical edge portion 4*b* having a flange 4*a* fitted into the retaining groove 13 is formed on the end face of the backward side of the rotating knob 4. A parallel pin or spring pin 14 is fitted into the outer circumference of the cylindrical edge portion 4*b* and the cylindrical edge portion 4*b* is pressed to insert into the retaining groove 13 so that the parallel pin or spring pin 14 is engaged with the inner engaging groove 13 thereby the whole rotating knob 4 is rotatably attached to the cylinder body 2.

A through-hole 15 through which the piston rod 5*a* is passed is formed at the shaft center of the rotating knob 4 and the movable stopper 9. Rotation transmitting pins 16 are projected at two positions around the through-hole 15 on the end face of the backward side of the rotating knob 4. Rotation transmitting holes 9*a* are formed at the corresponding two positions on the end face of the forward side of the movable stopper 9. Each of the rotation transmitting pins 16 is slidably inserted into the rotation transmitting holes 9*a*.

While the movable stopper 9 is located at the inmost forward side, a screw hole 17 is formed on the upper surface of the cylinder body 2 in the same axial position as the forward end of the movable stopper 9 as shown FIG. 2B. A stopper set screw 18 is screwed into the screw hole 17.

The supply and discharge ports 6 and 7 are formed on the upper surface of the cylinder body 2 as shown FIG. 2B. The compressed air is supplied and discharged to/from the backward fluid pressure chamber 11*a* and the forward fluid pressure chamber 11*b* through the supply and discharge ports 6 and 7.

While the movable stopper 9 is located the inmost backward side, the supply and discharge port 6 in communication with the backward fluid pressure chamber 11*a* is located at the same axial position as a chamfered portion 9*b* formed on the outer circumference of the end of the backward side of the movable stopper 9. Thereby the supply and discharge port 6 is in sure communication with the backward fluid pressure chamber 11*a* even if the movable stopper 9 is located at the backward limit. The axial length X of the forward end 12*a* having the small diameter of the piston 12 is approximately equal to the movable length Y (stroke adjustment length) of the movable stopper 9. Thereby the supply and discharge port 6 is not blocked up by the slidable middle portion 12*b* of the piston and consistently maintained to be in communication with the backward fluid pressure chamber 11*a* even if the movable stopper 9 is located at the forward limit and the piston 12 is located at the stroke end of the forward side.

While the piston 12 is located at the stroke end of the backward side, the supply and discharge port 7 in communication with the forward fluid pressure chamber 11*b* is located at the same axial position as backward end 12*c* having the small diameter. Thereby the supply and discharge port 7 is not blocked up by the slidable middle portion 12*b* of the piston 12 consistently maintained to be in communication with the backward fluid pressure chamber 11*b*.

An O ring 19 is provided on the outer circumference of the movable stopper 9 and the cylinder-head cover 10. A seal ring 20 is provided on the outer circumference of the slidable middle portion 12*b* of the piston 12. A packing 21 is provided in the through-hole 15 of the movable stopper 9. In the above-mentioned present embodiment, an axle member is composed of the piston 12 and the piston rod 5*a*, and a stroke end adjusting mechanism is composed of the rotating knob 4, the rotation transmitting pins 16 and the movable stopper 9.

Next, the operation of the fluid pressure cylinder 1 according to the present embodiment is described. When the movable stopper 9 is located at the forward limit as shown FIG. 2A, the forward stroke end of the piston 12 is located at the most forward side and the axial length of the cylinder chamber 11, i.e. the moving stroke of the piston 12 is most lengthened.

At this time, the rotating knob 4 is rotated to rotate the movable stopper 9 by the two rotation transmitting pins 16 so that the movable stopper 9 is screwed and backwardly moved away from the knob 4. However, each of the rotation transmitting pins 16 fixed to the rotating knob 4 remains inserted in slidable contact with the rotation transmitting hole 9*a* of the movable stopper 9 so that the rotation of the rotating knob 4 can be transmitted to the movable stopper 9. Thus the movable stopper 9 is backwardly moved so that the axial position of the end face of the backward side thereof, i.e. the stroke end position of the forward side of the piston 12 is also backwardly moved and the moving stroke of the piston 12 is shortened thereby.

According to the present embodiment as described above, the stroke end position of the forward side and the moving stroke of the piston 12 can be adjusted by rotating the rotating knob 4 to change the axial position of the movable stopper 9. Additionally, the total length of the fixed portion combined the rotating knob 4 with the cylinder body 2 is not changed during the adjustment. Further, the axially long adjustment member such as an adjusting rod is not provided at the end the backward side of the cylinder body 2 thereby to be installed in a small space.

Figure 3:
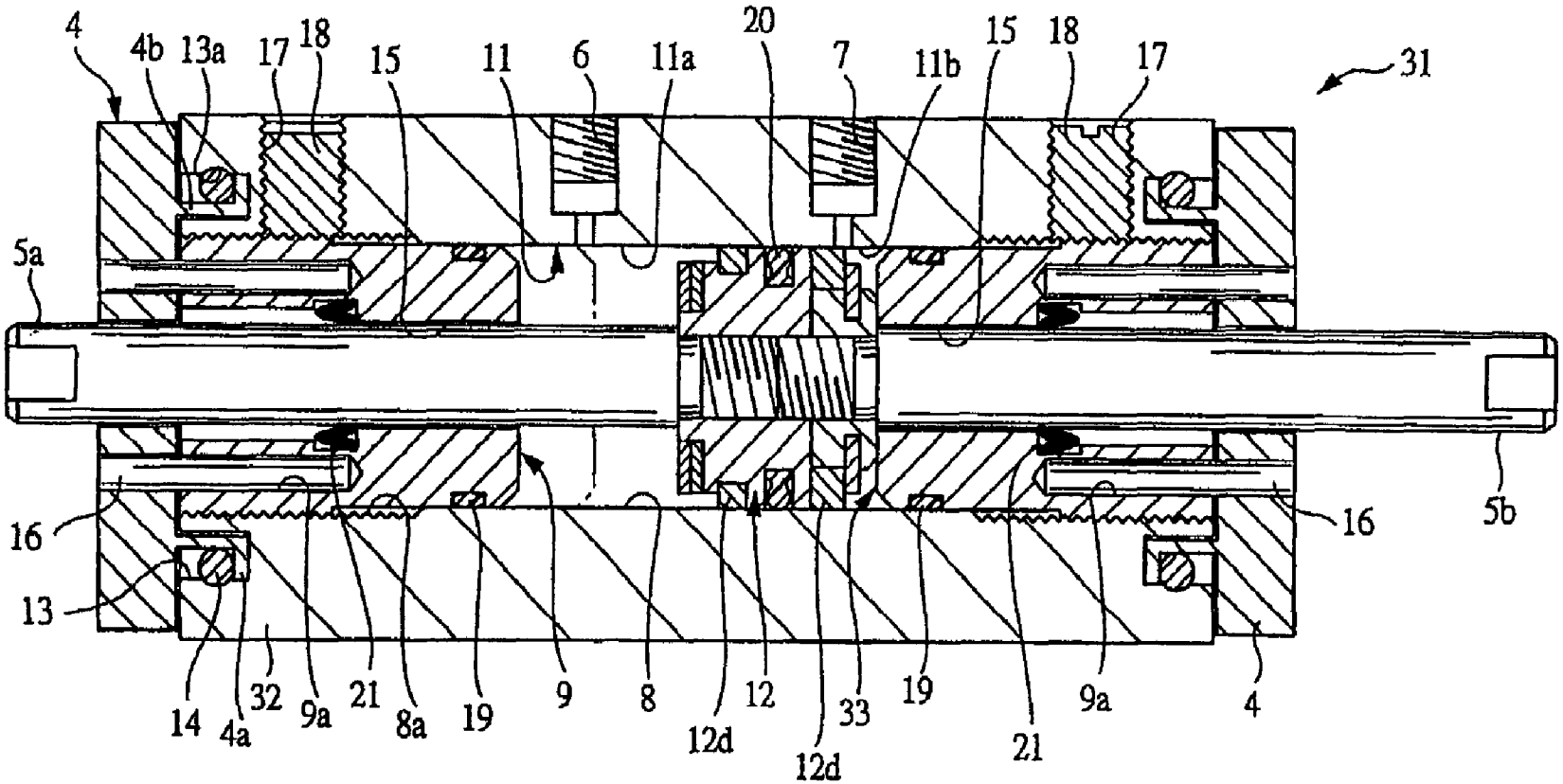
FIG. 3 is a sectional view of the fluid pressure cylinder according to the modification of the embodiment.

FIG. 3 is a sectional view of the fluid pressure cylinder 31 according to the modification of the present embodiment. Where, the same reference letters and numerals are used to designate the same or similar components as those of FIG. 1, FIG. 2A, and FIG. 2B. A stroke adjusting mechanism is provided at both end of the cylinder body 32 of the fluid pressure cylinder 31 and a piston rod 5*a* and 5*b* are provided at both end of the piston 12 thereby a double rod cylinder is formed.

According to the modification, not only both side of the axial position of the stroke end positions of the piston 12 can be independently adjusted but also the whole axial position can be adjusted without changing the stroke length by simultaneously moving two movable stoppers 9 and 33 in the same direction.

Incidentally, both of the stroke end adjusting mechanism and the piston rods 5*a* and 5*b* are provided at the forward side and the backward side in the modification, however, either of the stroke end adjusting mechanism or the piston rods 5*a* and 5*b* may be provided at the both of the forward side and the backward side. For example, the stroke end adjusting mechanism is provided at both ends of the cylinder body 32 and the piston rod 5*a* is provided at only the forward side of the cylinder body 32. Alternatively, the stroke adjusting mechanism is provided at only the forward side of the cylinder body 32 and the piston rods 5*a* and 5*b* are provided at both of the forward side and the backward side.

Figure 4:
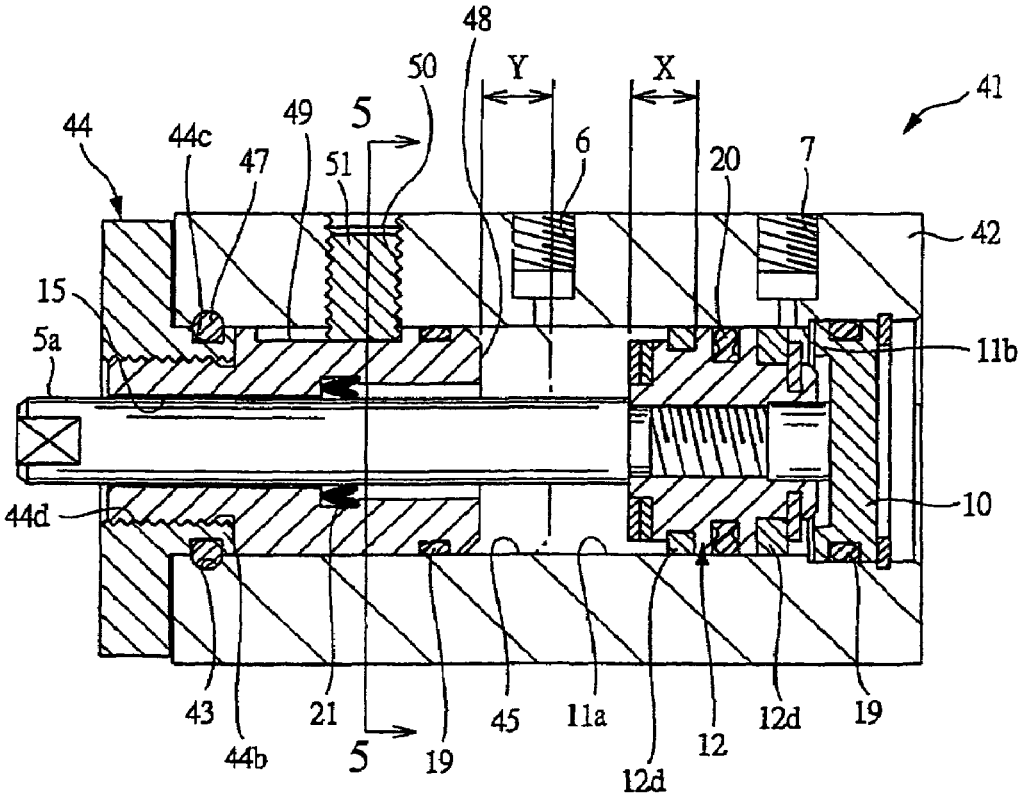
FIG. 4 is a sectional view of the fluid pressure cylinder according to another embodiment.
Figure 5:
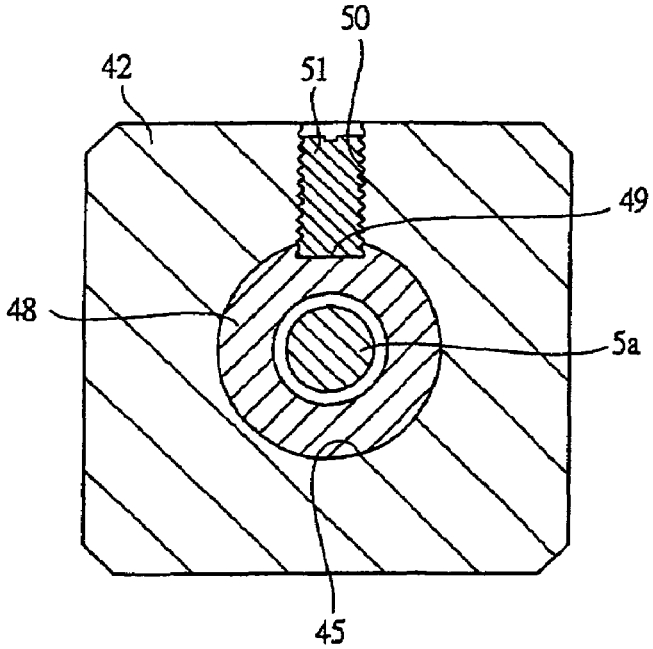
FIG. 5 is a sectional view along the B-B line of FIG. 4.

FIG. 4 is a sectional view of the fluid pressure cylinder according to another embodiment. FIG. 5 is a sectional view along the B-B line of FIG. 4. Where, the same reference letters and numerals are used to designate the same or similar components as those of the fluid pressure cylinder 1 of FIG. 2A and FIG. 2B as shown in FIG. 4 and FIG. 5.

In FIG. 4, an engaging groove 43 is formed on the inner circumference of the forward side of a piston receiving hole 45. A cylindrical edge portion 44*b* to be fitted into the piston receiving hole 45 is formed on the end face of the backward side of a rotating knob 44. A parallel pin or spring pin 47 is fitted into an engaging groove 44*c* formed on the outer circumference of the cylindrical edge portion 44*b* and the cylindrical edge portion 44*b* is pressed to insert into the piston receiving hole 45 so that the parallel pin or spring pin 47 is engaged with the engaging groove 44*c* at the cylindrical edge portion 44*b* and the engaging groove 43 into the piston receiving hole 45. Thereby the whole rotating knob 44 is rotatably attached to a cylinder body 42. A female screw 44*d* having the larger diameter than the piston rod 5*a* is formed at the center of the rotating knob 44. The forward side portion of a movable stopper 48 is screwed into the rotating knob 44 and the backward side portion of that is slidably mounted in the piston receiving hole 45. An engaging groove 49 is formed on the upper side surface of the movable stopper 48 as shown FIG. 4 and FIG. 5. A stopper set screw 51 as a rotation stopping member is screwed into a screw hole 50 formed on the upper surface of the cylinder 42 to engage with the engaging groove 49 as shown FIG. 4 and FIG. 5.

According to another embodiment as mentioned above, the movable stopper 48 is engaged with the stopper set screw 51 thereby not to rotate about the axis but only axially move. Additionally, the movable stopper 48 is certainly screwed to axially reciprocate by rotating the rotating knob 44.

Accordingly, the stroke end position of the forward side and the moving stroke of the piston 12 can be adjusted by changing the axial position of the movable stopper 48 as well as the above mentioned one embodiment. Additionally, the total length of the fixed portion is not changed during adjusting thereby to be installed in a small space. Further, the stroke adjusting mechanism can be provided at not only the end of the forward side of the cylinder body 42 but also the end of the backward side thereof. The piston rod 5*a* may be provided at both end of the piston 12 to be served as a double rod cylinder. The movable stopper 48 can be fixed by tightening up the stopper set screw 51.

It is to be understood that the present invention is not intended to be limited to the above-described embodiments, and various changes may be made therein without departing from the spirit of the present invention. For example, the fluid pressure for the operation control may be hydraulic pressure such as hydraulic fluid instead of air pressure by compressing the air. Additionally, the present invention may be applied to a cylinder body formed of circular cross section.

INDUSTRIAL APPLICABILITY

As thus described above, the fluid pressure cylinder according to the present invention can be effectively applied to an actuator used for such as an equipment to convey electronic components, e.g. semiconductor chips thereby the stroke end position of both of the forward side and the backward side, or the stroke length of the piston rod therebetween can be optionally adjusted depending on various components in different form.

The invention claimed is:

1. A fluid pressure cylinder comprising:

a cylinder body having a cylinder chamber therein;

an axle member including a piston axially reciprocally mounted in the cylinder chamber and separating the cylinder chamber into a forward fluid pressure chamber and a backward fluid pressure chamber and a piston rod externally and axially projecting from the cylinder body;

a movable stopper having a through-hole which is penetrated by the piston rod and being threadably engaged with a female screw formed in an end portion of the cylinder body to control a stroke end position of the piston;

an O-ring provided on an outer circumference of the movable stopper;

a rotating knob having a second through-hole which is penetrated by the piston rod and being substantially disk-shaped provided rotatably on an end face of the cylinder body;

a rotation transmitting pin fixed to and extending axially from the rotating knob, the rotation transmitting pin slidably inserted into a rotation transmitting, axially extending hole formed in the movable stopper for transmitting rotation of the rotating knob to the movable stopper; and a knob attaching structure including:

a retaining groove formed in the cylinder body opposite to the rotating knob on an outer circumference side of an opening of the cylinder chamber;

a cylindrical edge portion having a flange fitted into the retaining groove and formed in the rotating knob; and a pin engaged with the flange in the retaining groove, wherein, by the rotating knob via the rotation transmitting pin, even when the movable stopper is moved axially away from the rotating knob, the rotation of the rotating knob continues to be transmitted to the movable stopper by the rotation transmitting pin and the movable stopper is made to be rotated to move the movable stopper axially thereby to adjust the stroke end position of the axial member.

2. The fluid pressure cylinder according to claim 1, wherein the cylinder body further comprises a fixing member for fixing the movable stopper.

3. The fluid pressure cylinder according to claim 1, wherein the piston rod in the axle member axially projects from the one and an opposite end portion of the cylinder body.

4. The fluid pressure cylinder according to claim 3, wherein another movable stopper is mounted at the opposite end portion of the cylinder body, and another rotating knob is provided at the opposite end portion of the cylinder body.

5. The fluid pressure cylinder according to claim 1, wherein a plurality of rotation transmitting pins fixed to the rotating knob are each slidably inserted into a corresponding one of a plurality of rotation transmitting holes formed in the movable stopper.

* * * * *